United States Patent [19]

Bako

[11] 4,343,164

[45] Aug. 10, 1982

[54] COMBINATION LOCKS

[75] Inventor: Lazlo Bako, Woodcliff Lake, N.J.

[73] Assignee: Presto Lock, Inc., Garfield, N.J.

[21] Appl. No.: 167,430

[22] Filed: Jul. 11, 1980

[51] Int. Cl.[2] ..... E05B 37/02

[52] U.S. Cl. ..... 70/312; 70/318

[58] Field of Search ..... 70/20–30, 70/67–76, 312, 315–318

[56] References Cited

U.S. PATENT DOCUMENTS

| | | | |
|---|---|---|---|
| 3,633,388 | 1/1972 | Atkinson | 70/316 |
| 3,720,082 | 3/1973 | Feinberg et al. | 70/25 |
| 3,766,758 | 10/1973 | Heine et al. | 70/25 |
| 3,800,571 | 4/1974 | Heine | 70/71 |
| 4,048,821 | 9/1977 | Bako et al. | 70/25 |
| 4,123,923 | 11/1978 | Bako | 70/74 |

*Primary Examiner*—Robert L. Wolfe

*Attorney, Agent, or Firm*—Shapiro and Shapiro

[57] ABSTRACT

A dial and sleeve type combination lock is provided with a shift member to move the sleeves out of coupling engagement with the dials for changing the combination of the lock. The shift member is operated by depressing a manual actuator portion thereof in an opening in the lock casing and the shift member includes a cam surface which moves the sleeves out of coupling engagement with the dials responsive to depression of the manual actuator portion by reaction of the shift member with an internal surface of the lock casing.

9 Claims, 9 Drawing Figures

COMBINATION LOCKS

BACKGROUND OF THE INVENTION

The use of combination locks, which dispense with the need for a separate key, has in recent years become increasingly popular on articles such as luggage articles, camera, and instrument cases, and the like.

Such locks commonly employ a mechanism whereby the combination of the lock can be changed to one of the user's own choice, by manipulation of a combination-changing device. In the case of locks, for example of the rotary dial and sleeve type, where, for combination changing it is necessary to move the sleeves or other combination elements axially out of coupling engagement with the dials or the like, this is normally effected by a shift member having a manual actuator. Generally, the actuator has only been accessible from the back of the lock, i.e., from the interior of the article to which the lock is applied, and, in certain instances, this has proved to be cumbersome in operation. Further, the actuator has generally needed to be moved in the axial direction of the movement of the sleeves relative to the dials in order to uncouple the dials from the sleeves. (See, for example, U.S. Pat. No. 3,800,571 to Heine, issued Apr. 2, 1974 and commonly assigned herewith.)

It is an object of the present invention to provide a novel form of shift mechanism for a combination lock of the type in which a plurality of combination elements such as sleeves, are moved axialy in unison in order to effect a combination change.

Another object of the invention is to provide a combination lock of the type having a plurality of combination elements adapted to be moved axially in unison in order to effect a combination change, wherein an actuator for shifting the elements is moved in a direction other than the axial direction of movement of the elements.

A further object of the invention is to provide a combination lock, suitable for use on articles of luggage and the like, wherein a shift mechanism for changing the combination of the lock is readily accessible from the exterior of the article to which the lock is applied.

It has previously been proposed in connection with combination padlocks, for example, which employ rotary dials and sleeves, to move the sleeves out of coupling engagement with the dials by utilizing the longer leg of the padlock shackle to provide axial movement of the sleeves, by movement of the shackle in a direction other than the direction of axial movement of the sleeves, see, for example, U.S. Pat. No. 3,766,578 to Heine et al., issued Oct. 23, 1973, and U.S. Pat. No. 4,048,821 to Bako et al., issued Sept. 20, 1977. The present invention, however, is primarily concerned with providing alternative and simplified means for effecting axial movement of the combination elements, for combination changing purposes, by means of an actuator which is operated other than in the direction of movement of the elements.

SUMMARY OF THE INVENTION

In accordance with the invention, at least in a preferred embodiment thereof, axial movement of the combination elements of a combination lock, in order to effect a change in combination, is provided by depressing a shift member having a manual actuator portion projecting through an opening in the lock casing. The shift member is mounted on a shaft which carries the combination elements and includes a cam portion effective to move the elements axially when the actuator portion is depressed, by reaction of the shift member with an internal surface of the lock casing.

In a preferred form of lock in accordance with the invention, the shift member cooperates with a locking member, for example, a pivotal bolt, in a manner whereby depression of the shift member to uncouple the combination elements from their cooperating combination components, can only be effected when the locking member is in an unlocked condition, i.e., when the lock is on-combination.

The shift member preferably further includes means cooperating with the locking member for holding the locking member in an unlocked condition when the combination elements are moved out of coupling engagement with their cooperating combination components, in order to avoid loss of the combination.

DESCRIPTION OF PREFERRED EMBODIMENT

The illustrated combination lock is of the generally known type employing a locking member in the form of a pivotal bolt adapted to engage a hasp, the bolt being movable between locking and unlocked positions under the control of a plurality of combination dials and sleeves. The arrangement is such that when the dials and sleeves are on combination, the bolt automatically assumes its unlocked position, in which the hasp can be inserted into or withdrawn from the lock, and when the dials and sleeves are off combination, the bolt automatically assumes its locking position in which it prevents an inserted hasp from being withdrawn from the lock.

Locks having the above type of locking and unlocking action are known, see, for example, U.S. Pat. No. 3,800,571, referred to above. It is to be understood that the present invention is not concerned with the locking and unlocking action per se, and this form of lock is merely used for illustrative purposes as one type of lock to which the present invention may be applied. Thus, the present invention is concerned with a shift mechanism for moving combination elements such as sleeves, axially out of coupling engagement with associated lock components in order to effect a combination change. The invention can be applied to locks having a locking and unlocking action different to the pivotal bolt type locking and unlocking action herein referred to.

Figure 1:
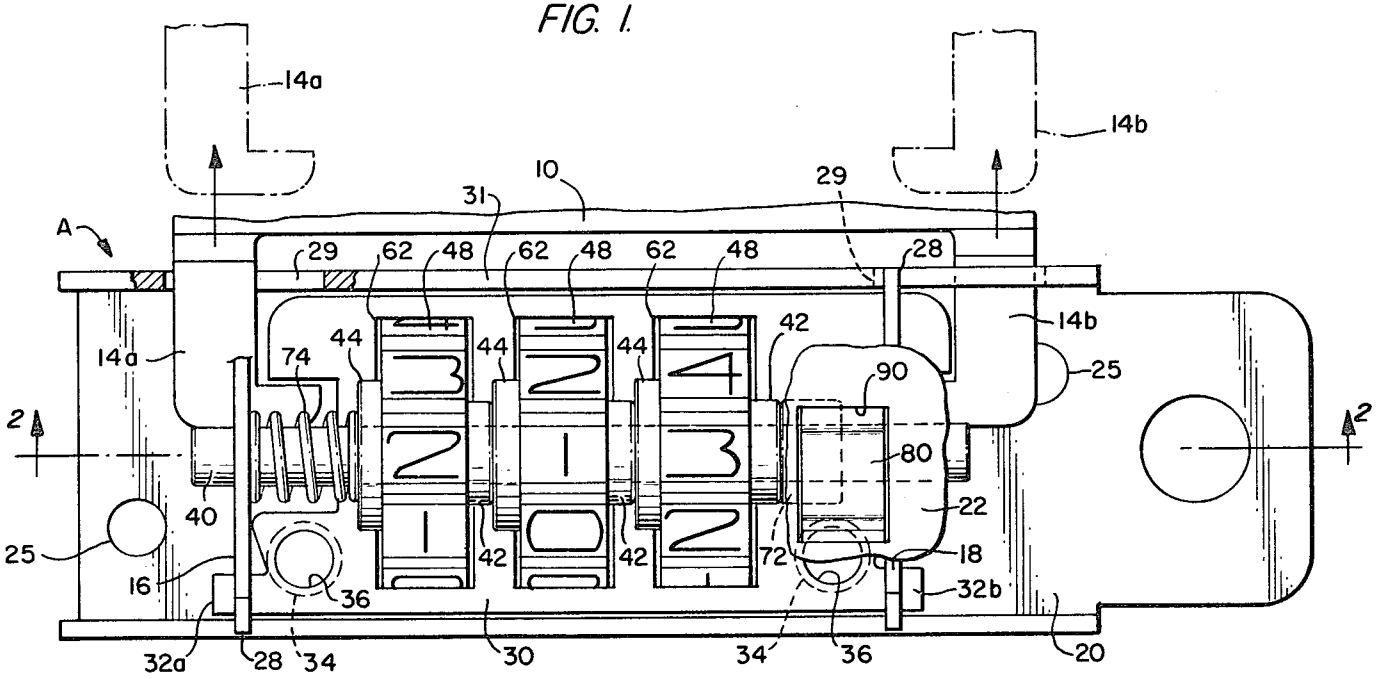
FIG. 1 is a plan view of a combination lock in accordance with the invention, with parts of the lock being cut away.
Figure 3:
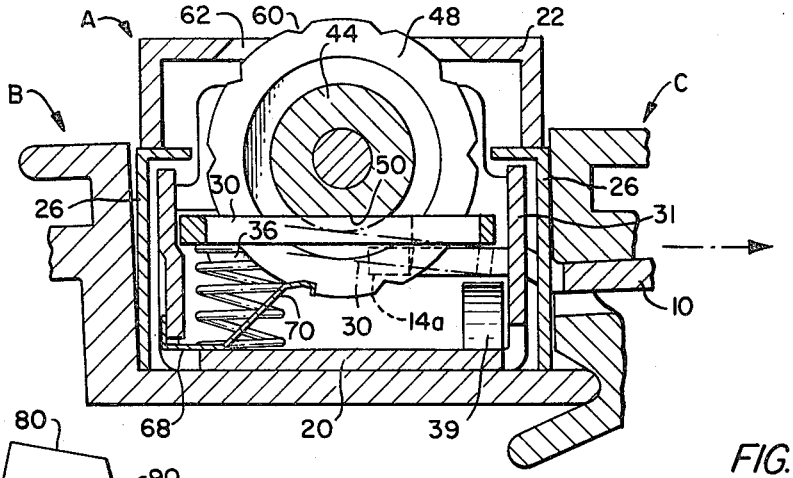
FIG. 3 is a cross section along line 3—3 of FIG. 2.

Referring now specifically to the drawings, the illustrated lock, generally indicated by reference A, may be attached to a valance B of one section of say a luggage article (see FIG. 3) with the other section C of the article carrying a hasp 10 having projecting tongues 14*a*, 14*b* (FIG. 1) adapted to enter openings in the lock and engage a pivotal bolt 30 to releasably secure the sections of the luggage or like article together.

Lock A has a casing which may, for example, be formed by a channel shaped base member 20, a face plate 22, side wall members 24 and 26, and end brackets 16 and 18. The design and assembly of the casing components is not critical and can follow established practice for locks of this type. As illustrated, base member 20 has openings 25 for attaching the lock as by screws, rivets, or the like, to valance B and side wall member 24 has openings 27 aligned with similar openings 29 in upright wall 31 of the base member, for admission of the hasp tongues 14*a* and 14*b*.

Figure 2:
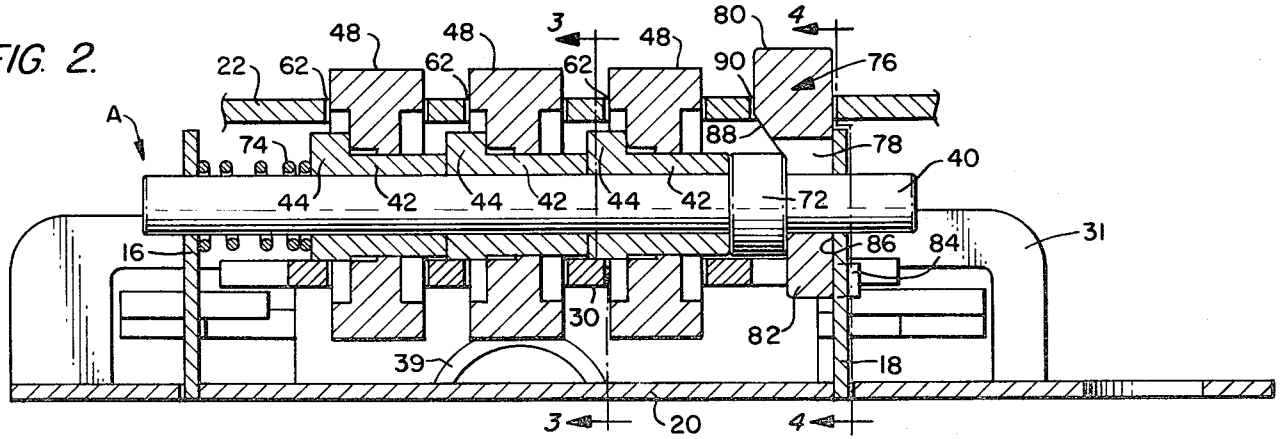
FIG. 2 is a longutidinal section along line 2—2 of FIG. 1.
Figure 6:
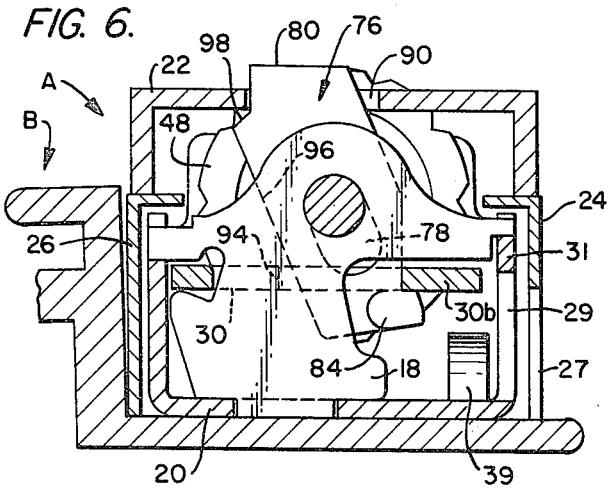
FIG. 6 is a view similar to FIG. 4 but showing the lock in combination changing position.
Figure 9:
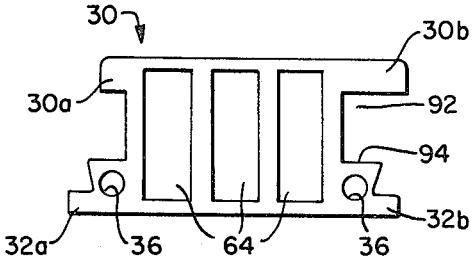
FIG. 9 is a plan view of a pivotal bolt.

Brackets 16 and 18 which define opposite end walls of the casing, respectively, may, for example, be located in recesses 28 in the opposed upright walls of base member 20. The pivotal bolt 30 (FIG. 9) is mounted in brackets 16 and 18 by ears 32*a*, 32*b* of the bolt which fit in corresponding openings in the brackets, and coil compression springs 34 act between base member 20 and bosses 36 on the undersurface of the bolt to urge the bolt upwardly into the position shown in FIGS. 2 and 6 are shown in solid line in FIGS. 3 and 4. In this, the unlocked position of the bolt, the hasp tongues 14*a* and 14*b* are free to enter and to be removed from the lock through openings 27 and 29. When bolt 30 is lowered, however, to the locking position, against springs 34, by means to be described, and as shown in phantom in FIGS. 3 and 4, bolts tongues 30*a* and 30*b* align vertically with the hasp tongues 14*a* and 14*b* to prevent disengagement with the hasp. Downward movement of bolt 30 is limited by a stop 39 on the base member 20.

Brackets 16 and 18 also serve to mount a shaft 40 carrying a series of combination elements in the form of sleeves 42, and encircling combination dials 48. The dials and sleeves are of conventional type insofar as the dials have internal teeth 56 of the like, which mesh with complementary teeth 58 or the like on the sleeves whereby the dials and sleeves are coupled for mutual rotation on the shaft 40. The dials also have a conventional series of circumferential combination indicia on their outer surfacs, with locating detents 60 therebetween and a portion of the periphery of each dial protrudes from casing 10 through respective slots 62 in face plate 22. Similarly, the dials protrude through aligned slots 64 in bolt 30. A conventional dial spring 68 on base member 20 has limbs 70 engaging in the detents 60 of the respective dials.

Shaft 40 further has a fixed or integrally formed collar 72 adjacent the right end sleeve 42, and a coil spring 74 surrounding the shaft and acting between bracket 17 and the left end sleeve. Between collar 72 and bracket 18, the shaft 40 carries a shift member 76, the shift member having an elongated opening 78 through which the shaft extends. Spring 74 urges the assembly of sleeves, shaft and shift member to the right as seen in FIG. 2, and holds the sleeves in coupling engagement with the respective dials.

Sleeves 42 have enlarged bosses 44 at the lefthand ends thereof defining circumferential cam surfaces. These cam surfaces have part-circular portions 46 and flattened portions 50, and the cam surfaces act on the upper surface of bolt 30 to control the position of the bolt. Thus, when all the sleeves are aligned by suitable manipulation of the dials, such that the flattened portions of the respective sleeves all engage the bolt (i.e., the on-combination condition), the bolt is free to rise to the unlocked position. If at least one of the sleeves is rotated from this position, the part-circular portion of the sleeve's cam surface cams the bolt down to the locked position. Thus, for the bolt to be unlocked, all the sleeves must have their flat portions in aligned engagement with the bolt and for the bolt to be locked, any one or more of the sleeves must be rotated so that the part-circular portion engages the bolt. This form of locking and unlocking action, as indicated, is known and will be readily apparent to those skilled in the art.

To enable the combination of the lock to be changed, it is necessary to move the sleeves 42 axially out of coupling engagement with the respective dials, so that at least one of the dials can be rotated independently of the respective sleeve. This is accomplished by shift member 75 when the lock is on combination as will now be described.

Figure 7:
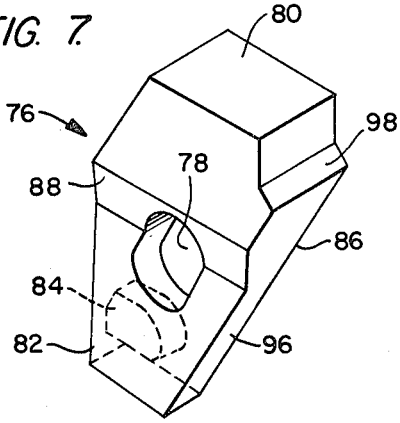
FIG. 7 is a perspective view of a shift member used in the lock.
Figure 8:
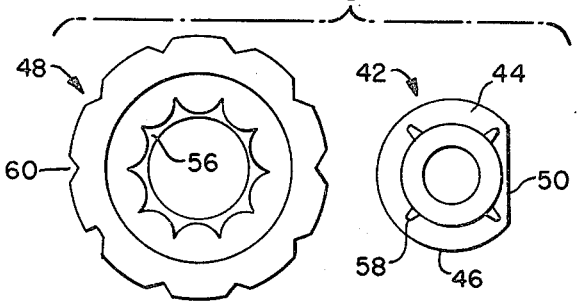
FIG. 8 is a composite end view of a combination dial and a combination sleeve.

Shift member 76, as shown particularly in FIG. 7, includes an upwardly projecting manual actuator portion 80, and a depending portion 82 with a projecting tab 84. The shift member is mounted on shaft 40 between collar 72 and bracket 18 and the action of spring 74 holds a rear surface 86 of the shift member in engagement with bracket 18. An inclined front surface 88 of the shift member engages collar 72 and the manual actuator portion 80 projects from the casing through an opening 90 in face plate 22.

Figure 4:
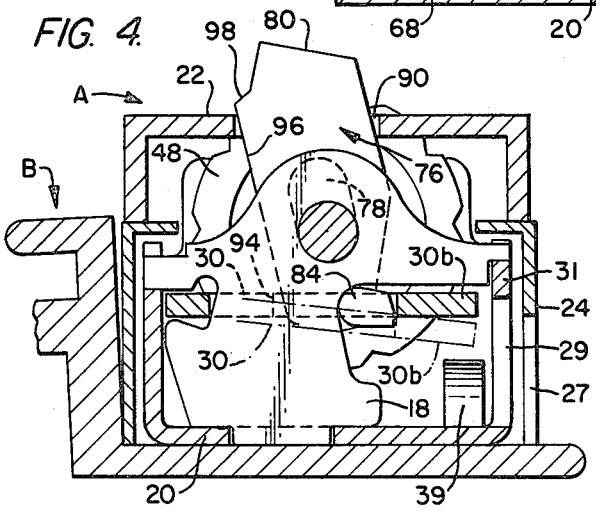
FIG. 4 is a cross section along line 4—4 of FIG. 2.
Figure 5:
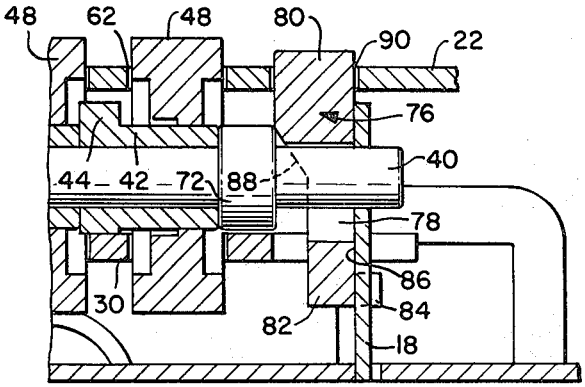
FIG. 5 is a view similar to FIG. 2 but showing parts of a lock in a combination changing position.

The normal rest position of the shift member 76 is shown in FIGS. 2 and 4. When the lock is off combination, the bolt being in its locked lowered position, shown in phantom in FIG. 4, tongue 30*b* of the bolt is in a blocking position with respect to tab 84 of the shift member and actuator portion 80 of the shift member cannot, therefore, be depressed in opening 90. When the lock is on combination, however, with the bolt in its raised, unlocked position, tongue 30*b* clears tab 84 and allows manual actuator portion 80 of the shift member to be depressed in opening 90. Depression of the shift member causes inclined surface 88 to act as a cam surface pressing collar 72 to the left as shown in FIG. 2, against the action of spring 74, and thereby axially moving sleeves 42 out of coupling engagement with the respective dials 48. It will be noted, that the shift member is confined to move downwardly at an oblique angle of approximately 20 degrees to the vertical due to the shift member being located in a cut-out portion 92 of bolt 30, the rear surface 94 of which acts as a guide for surface 96 of shift member during downward movement therof.

Further, during depression of the shift member, the rear surface 86 reacts with the internal surface of bracket 18 to provide the camming action of surface 88 against collar 72.

When the shift member has been depressed, it can be rotated in a counterclockwise direction on shaft 40 as shown in FIG. 6, to bring surface 98 of the shift member into engagement under the edge of the face plate defining opening 90, thereby retaining the shift member in the depressed position, and bringing tab 84 into engagement under bolt tongue 30*b*. In this condition, the shift member can be released and the sleeves will be held out of coupling engagement with respective dials to allow the combination of the lock to be changed. Further, in this position of the shift member, tab 84 prevents the bolt from being lowered into its locked position thereby preventing the sleeves 42 from rotating and losing the combination. After the combination of the lock has been changed, the shift member can be rotated in a clockwise direction as seen in FIG. 6 and spring 74 returns the sleeves axially into coupling engagement with the respective dials thereby setting the new combination. Simultaneously, collar 72 acting against surface 88 of the shift member returns the shift member to its upper rest position.

It will be seen from the foregoing that the invention provides a convenient form of shift mechanism for use with combination locks, suitable for application to articles of luggage and the like, which shift mechanism can be operated from the top of the lock casing, i.e., from externally of the article to which the lock is applied. Further, the shift mechanism is operated by moving a manual actuator other than in the direction of movement of the combination elements that are moved.

While only a single preferred embodiment of the invention has been described herein in detail, it is to be understood that the invention is not limited thereby, and modifications can be made within the scope of the attached claims.

I claim:

1. A combination lock including a plurality of combination elements disposed coaxially on a shaft in a lock casing for axial movement in unison out of coupling engagement with cooperating combination components in order to change the combination of the lock, a shift member mounted on said shaft adjacent a terminal one of said combination elements through an elongated opening in said shift member, said shift member including a manual actuator portion projecting through an opening in the lock casing and said shift member being movable from a rest position substantially transversely to the axis of said shaft by depression of said actuator portion in said opening, said shift member further including a cam surface for moving said elements axially responsive to depression of said actuator portion in said opening by reaction of said shift member with an internal surface of the lock casing, means for releasably retaining the shift member in position when the actuator portion is depressed to hold said elements and said cooperating components out of coupling engagement, and means acting on said cam surface for returning the shift member to the rest position upon release of said retaining means and return of said elements into coupling engagement with said cooperating components.

2. A lock as defined in claim 1, wherein said combination elements comprise sleeves mounted in axially abutting relation on said shaft and said cooperating combination components comprise dials encircling said sleeves, said dials having peripheral portions extending through slots in a face plate of the lock, said opening in said casing being formed in said face plate.

3. A lock as defined in claim 2, including a collar on said shaft between said terminal one of said combination elements and said shift member, said cam surface of said shift member engaging said collar to move said shaft and said sleeves axially responsive to depression of said actuator portion in said opening in said casing.

4. A lock as defined in claim 1, including a locking member in said casing controlled by said combination elements for movement between locking and unlocked positions, said shift member including a tab adapted to engage said locking member when said locking member is in locking position for inhibiting depression of said actuator portion in said opening to effect a combination change, said tab clearing said locking member when said locking member is in unlocked position.

5. A lock as defined in claim 4, wherein said shift member and said locking member have cooperating surfaces confining said shift member to movement obliquely with respect to the lock casing, responsive to depression of said manual actuator portion.

6. A lock as defined in claim 4, wherein said actuator portion has a terminal position in said opening for holding said combination elements in combination changing position, said tab engaging said locking member in said terminal position of the actuator portion to retain said locking member in unlocked position.

7. A combination lock including a plurality of combination elements disposed coaxially on a shaft in a lock casing for axial movement in unison out of coupling engagement with cooperating combination components in order to change the combination of the lock, a shift member mounted on said shaft adjacent a terminal one of said combination elements through an elongated opening in said shift member, said shift member including a manual actuator portion projecting through an opening in the lock casing and said shift member being movable substantially transversely to the axis of said shaft by depression of said actuator portion in said opening, said shift member further including a cam surface for moving said elements axially responsive to depression of said actuator portion in said opening by reaction of said shift member with an internal surface of the lock casing, a locking member in said casing controlled by said combination elements for movement between locking and unlocked positions, said shift member including a tab adapted to engage said locking member when said lcoking member is in locking position for inhibiting depression of said actuator portion in said opening to effect a combination change, said tab clearing said locking member when said locking member is in unlocked position, wherein said actuator portion has a terminal position in said opening for holding said combination elements in combination changing position, said tab engaging said locking member in said terminal position of the actuator portion to retain said locking member in unlocked position, and wherein said shift member includes an upper surface adapted to engage under an edge portion of the casing defining said opening when the actuator portion is in said terminal position, said shift member being moved to said terminal position by rotation relative to the axis of said shaft.

8. A lock as defined in claim 4, wherein said locking member is a pivotal bolt and said sleeves each include a flange having a cam surface engaging said bolt for controlling movement of said bolt between said locking and said unlocked positions dependent upon the alignment of the respective cam surfaces.

9. A lock as defined in claim 3 including spring means urging said dials and sleeves into coupling engagement and urging said collar toward engagement with said cam surface, said spring means and collar comprising said means acting on said cam surface for returning the shift member to the rest position.

* * * * *